US010704225B2

(12) United States Patent
Guggino et al.

(10) Patent No.: US 10,704,225 B2
(45) Date of Patent: Jul. 7, 2020

(54) COUPLING FOR CONTAINMENT PLOWS AND PUSHERS

(71) Applicant: Pro-Tech Manufacturing and Distribution, Inc., Rochester, NY (US)

(72) Inventors: Michael J. Guggino, Bloomfield, NY (US); James Maier, Ontario, NY (US)

(73) Assignee: Pro-Tech Manufacturing and Distribution, Inc., Rochester, NY (US)

( * ) Notice: Subject to any disclaimer, the term of this patent is extended or adjusted under 35 U.S.C. 154(b) by 233 days.

(21) Appl. No.: 15/629,704

(22) Filed: Jun. 21, 2017

(65) Prior Publication Data

US 2017/0370069 A1 Dec. 28, 2017

Related U.S. Application Data

(60) Provisional application No. 62/353,162, filed on Jun. 22, 2016.

(51) Int. Cl.

| | |
|---|---|
| ***E02F 3/76*** | (2006.01) |
| ***E01H 5/06*** | (2006.01) |
| ***E02F 9/00*** | (2006.01) |
| ***E02F 3/36*** | (2006.01) |

(52) U.S. Cl.

CPC ..... *E02F 3/7622* (2013.01); *E01H 5/061* (2013.01); *E02F 3/3604* (2013.01); *E02F 3/3686* (2013.01); *E02F 9/006* (2013.01)

(58) Field of Classification Search

CPC ..... E02F 3/7633; E02F 3/3604; E02F 3/3686; E02F 9/006; E01H 5/061

See application file for complete search history.

(56) References Cited

U.S. PATENT DOCUMENTS

| | | | | | |
|---|---|---|---|---|---|
| 1,402,078 | A * | 1/1922 | McCauley | E02F 3/6463 | 37/411 |
| 1,418,973 | A * | 6/1922 | Roberts | E02F 3/6463 | 37/411 |
| 1,473,890 | A * | 11/1923 | Toy | E02F 3/7631 | 172/240 |
| 1,530,100 | A * | 3/1925 | Arndt | E01C 19/264 | 172/170 |
| 1,686,176 | A * | 10/1928 | Robin | B66C 3/12 | 37/184 |
| 1,997,001 | A * | 4/1935 | Lamb | E02F 3/7613 | 172/815 |
| 2,622,349 | A * | 12/1952 | Kinnan | E02F 3/7627 | 172/445.2 |
| 2,630,232 | A * | 3/1953 | Silver | E02F 3/34 | 172/308 |
| 2,684,163 | A * | 7/1954 | Boulton | E02F 3/34 | 37/407 |
| 2,763,942 | A * | 9/1956 | Adams | E02F 3/6481 | 37/424 |
| 2,781,926 | A * | 2/1957 | Sights | E02F 3/47 | 37/411 |

(Continued)

*Primary Examiner* — Jamie L McGowan

(74) *Attorney, Agent, or Firm* — Duane C. Basch; Basch & Nickerson LLP

(57) ABSTRACT

A pivot coupling system that permits the use of attachable equipment such as material pushers or containment plows with a range of vehicles including all-terrain vehicles (ATVs), utility task vehicle (UTV), lawn and garden tractors, small farm tractors, small trucks, skid-steer loaders, etc.

15 Claims, 6 Drawing Sheets

(56) References Cited

U.S. PATENT DOCUMENTS 2,940,193 A * 6/1960 Banks ..... E02F 3/7686 172/706
3,011,276 A * 12/1961 Likely ..... E02F 3/7613 172/817
3,157,099 A * 11/1964 Ulrich ..... E02F 3/7613 172/200
3,378,084 A * 4/1968 Ulrich ..... E02F 3/7613 172/247
3,591,935 A * 7/1971 Bremmer ..... E02F 3/3604 172/819
3,662,841 A * 5/1972 Molby ..... E02F 3/7618 172/824
3,672,521 A * 6/1972 Bauer ..... E02F 3/3622 414/723
3,698,490 A * 10/1972 King ..... E02F 3/7618 172/824
3,831,690 A * 8/1974 Yamaoka ..... B62D 11/08 180/6.66
4,006,782 A * 2/1977 Nishino ..... E02F 3/7618 172/815
4,076,080 A * 2/1978 Anderson ..... E02F 3/7613 172/247
4,084,643 A * 4/1978 Easterling ..... E02F 3/7645 172/743
5,069,296 A * 12/1991 Horsch ..... E02F 3/7618 172/825
5,075,985 A * 12/1991 Mensch ..... A01B 31/00 15/245
5,252,022 A * 10/1993 Culp ..... E02F 3/3622 172/273
5,431,528 A * 7/1995 Jenkins ..... E02F 3/3631 172/275
5,568,694 A * 10/1996 Capra ..... E01H 5/06 37/231
6,035,478 A * 3/2000 Miller ..... A46B 13/02 15/82
6,973,976 B1 * 12/2005 Turgeon ..... B60D 1/02 172/677
7,448,453 B2 * 11/2008 Tobin ..... E02F 3/7627 172/817
8,061,063 B2 * 11/2011 Gamble, II ..... E01H 5/063 172/815
9,885,160 B1 * 2/2018 Stone ..... E01H 5/061
2003/0056962 A1 * 3/2003 Banko ..... A01B 31/00 172/438
2009/0050340 A1 * 2/2009 McIntyre ..... A01B 59/06 172/182
2017/0254049 A1 * 9/2017 Kean ..... E02F 9/26
2017/0370069 A1 * 12/2017 Guggino ..... E02F 3/3604

* cited by examiner

COUPLING FOR CONTAINMENT PLOWS AND PUSHERS

This application claims priority under 35 U.S.C. § 119(e) from U.S. Provisional Patent Application No. 62/353,162 for a PIVOT COUPLING FOR CONTAINMENT PLOWS AND PUSHERS, by M. Guggino et al, filed Jun. 22, 2016, which is hereby incorporated by reference in its entirety.

The embodiments disclosed herein are directed to an improved, simplified coupling that permits the use of material pushers, containment plows (e.g., snow pushers) and similar attachable equipment with a variety of vehicles that can be used to move equipment such as plows/pushers, including all-terrain vehicles (ATVs), utility task vehicle (UTV), lawn & garden tractors, small farm tractors, small trucks, skid-steer loaders, etc.

BACKGROUND AND SUMMARY

Conventional snow pushers and similar containment plows have, for the most part, been designed for use with large vehicles such as loaders, backhoes and similar heavy-duty equipment that have buckets or other standard coupling mechanisms to allow the vehicle to be easily attached to the containment plow. As containment plows are becoming more accepted for plowing, cleaning and maintaining smaller areas, or areas that cannot withstand the weight of heavy equipment (e.g., turf football fields, feed lots, bladder-lined reservoirs, etc.), a need has been recognized to easily fit such containment plows and similar attachable equipment to smaller vehicles. However, an impediment to simply putting a containment plow on the front of an ATV or a UTV, as that such vehicles have different coupling mechanisms, and require customizations in order to work with conventional couplers used on such plow/pushers. Moreover, some vehicles lack or have limited ability to raise and lower a plow attached to the front of the vehicle, let alone adjust the angle of tilt of the plow relative to a surface being plowed.

Recognizing a need to provide improved connect-ability for containment plows, material pushers and the like, the various embodiments described herein seek to "standardize" the containment plow with a simple pivoting attachment mechanism, and thereby enabling use of such equipment by only altering the vehicle interface in order to fit the same plow, or same plow model to different vehicles. In doing so, customized couplers have been designed to fit a range of different vehicles and the couplers each have a plow interface that is common, including a pivoting connection to allow the plow/pusher to "ride" over surface changes while still providing a tilt-angle limiting feature. The plow interface provides for easy separation of the plow from the coupler by removal of a pivot pin(s). Moreover, the ease of coupling/uncoupling the plow allows for multiple vehicles to be fit with a coupler which allows a plow outfitted with the coupling to be used interchangeably with several vehicles.

Disclosed in embodiments herein is a material pusher coupling system, comprising: a material pusher having a pair of spaced-apart hinge bosses (knuckles) attached to a rear of the pusher and located along a common axis parallel with the longitudinal axis of the material pusher; a vehicle coupler including a pusher interface on one side thereof and a vehicle interface on another side thereof, where the pusher interface includes at least one hinge boss fitting between the spaced apart hinge bosses in a position where a common hinge pin extends through the interior of the spaced-apart hinge bosses and the at least one hinge boss, so as to cause the material pusher and the vehicle coupler to be in a pivoting, hinged connection to one another; and wherein the vehicle interface is suitable for attachment to structural components of the vehicle to which the material pusher is to be attached for use.

Also disclosed in embodiments herein is an equipment coupling system, comprising: an attachable piece of equipment having a pair of spaced-apart hinge bosses attached to a rear thereof, the hinge bosses being located along a common axis, said axis being parallel with a longitudinal axis of the piece of equipment; a vehicle coupler including an equipment interface on one side thereof and a vehicle interface on another side thereof, where the equipment interface includes at least one hinge boss, fitting between the spaced apart hinge bosses, in a position where a common hinge pin extends through the interior of the spaced-apart hinge bosses and the at least one hinge boss on the vehicle coupler, to cause the piece of equipment and the vehicle coupler to be in a pivoting, hinged connection to one another; and wherein the vehicle interface is suitable for attachment to components of the vehicle to which the piece of equipment is to be attached for use.

Further disclosed in embodiments herein is an alternative embodiment where pins are employed for the connection of equipment to vehicles, for example, an equipment coupling system, comprising: an attachable piece of equipment having at least one pair of spaced-apart first bosses attached to a rear thereof, each pair of first bosses being located and aligned along a common axis, said axis being parallel with a longitudinal axis of the piece of equipment; a vehicle coupler including an equipment interface on one side thereof and a vehicle interface on another side thereof, where the equipment interface includes at least one pair of second bosses for each of the first bosses on the attachable piece of equipment, wherein for each of said first bosses and associated pair of second bosses a common pin extends through the interior of the first boss and pair of second bosses on the ends thereof to cause the piece of equipment and the vehicle coupler to be connected to one another; and wherein the vehicle interface is suitable for attachment to components of the vehicle to which the piece of equipment is to be attached for use.

Figure 1:
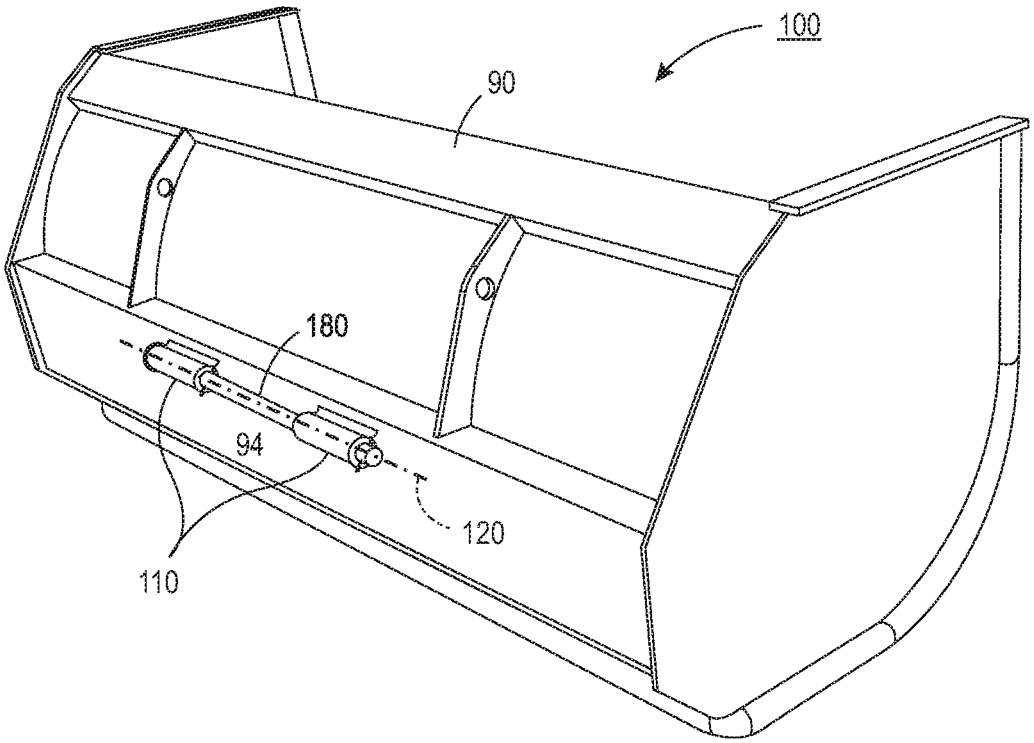
FIGS. 1-3 illustrate components of a material pusher (e.g., a turf pusher) and an associated coupler in accordance with a disclosed embodiment.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 2:
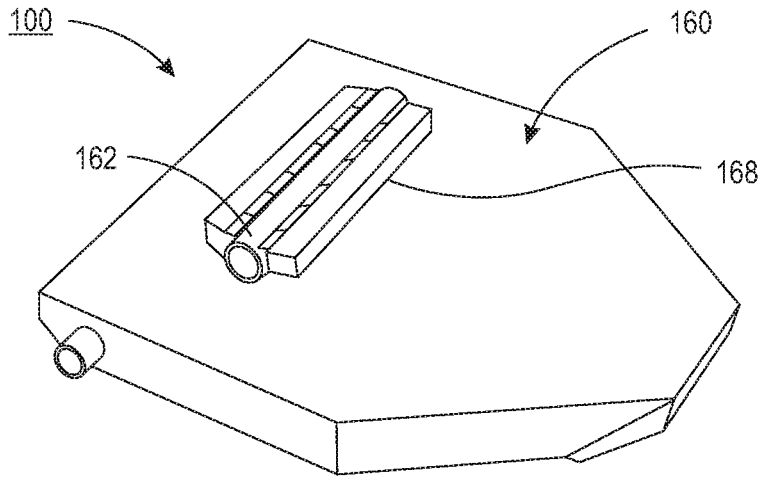
Figure 3:
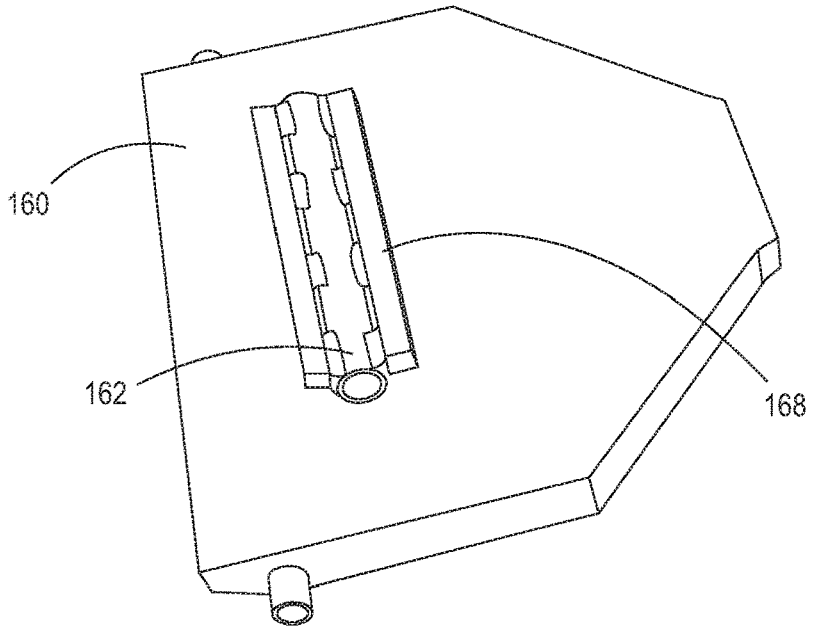
Figure 4:
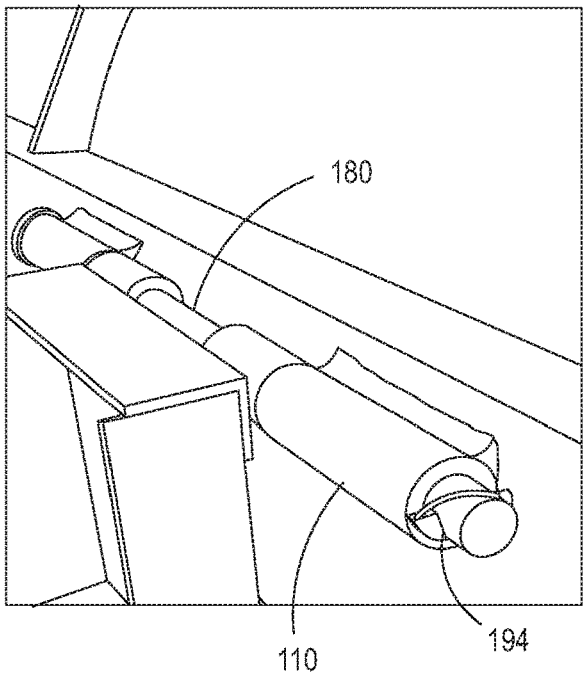
FIG. 4 is an exemplary illustration of the pivot coupling system with a "dummy" coupler.
Figure 5:
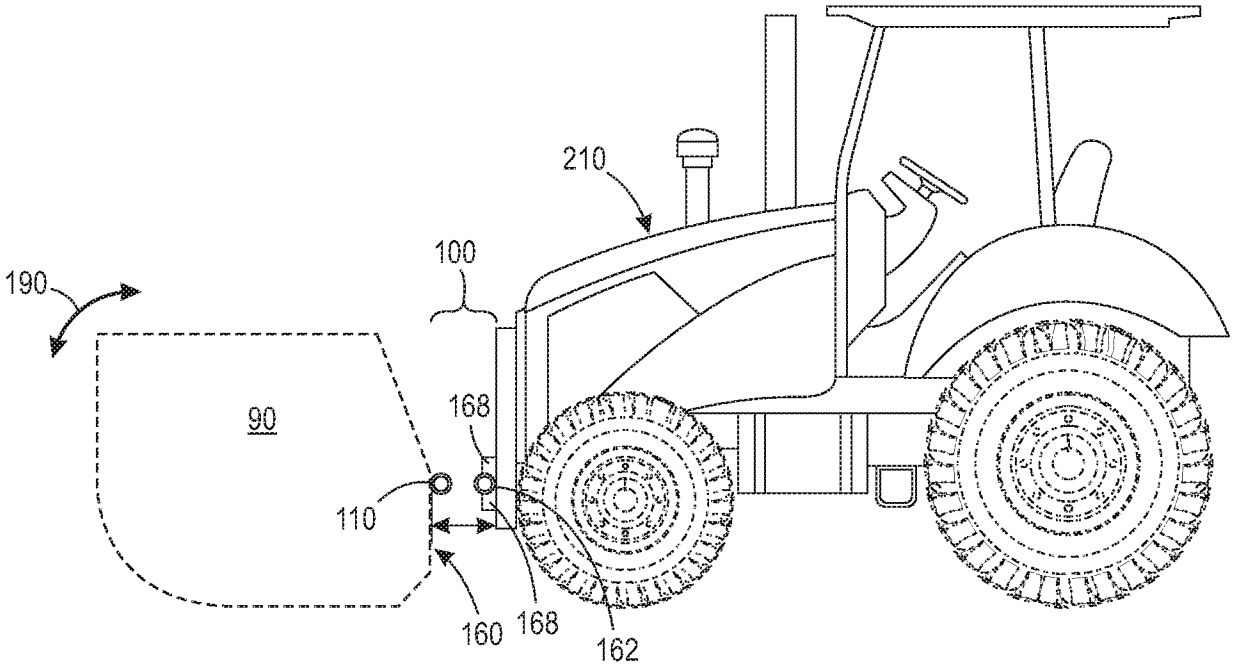
FIG. 5 is a side view of an exemplary embodiment of the coupling system.

Referring to the figures, depicted therein are various embodiment of the disclosed pivoting coupling system. For example, in FIGS. 1-3, there is shown a material pusher coupling system 100. The system includes a piece of equipment such as a material pusher 90 having a pair of spaced-apart hinge bosses 110 (also referred to as hinge knuckles) attached to a rear surface or structure 94 of the pusher and located along a common axis 120, parallel with the longitudinal axis of the material pusher. Also included is a vehicle coupler 160 including a pusher interface on one side thereof and a vehicle interface on another side thereof, where the pusher interface side includes at least one hinge boss 162 designed to fit in-between the spaced apart hinge bosses in a position where a common hinge pin 180 extends through the interior of the spaced-apart hinge bosses and the at least one hinge boss on the coupler, thereby causing the material pusher and the vehicle coupler to be in a pivoting or hinged connection to one another. And, as illustrated, for example, in FIG. 5, the vehicle interface is suitable for attachment to structural components of the vehicle 210 to which the material pusher is to be attached for use.

As illustrated in FIGS. 2-3, 5 and 7, the pusher interface or coupler 160 may include an angular limit device(s) 168 in the form of a block, weldment, or possibly even a deformable material, attached to the front of the interface adjacent the hinge boss 162—in one embodiment the angular limits 168 are attached on and parallel with either side of the boss itself. The angular limit 168 is intended to control the relative amount of pivot (rotation) of the material pusher 90 with respect to the vehicle 210.

Figure 6A:
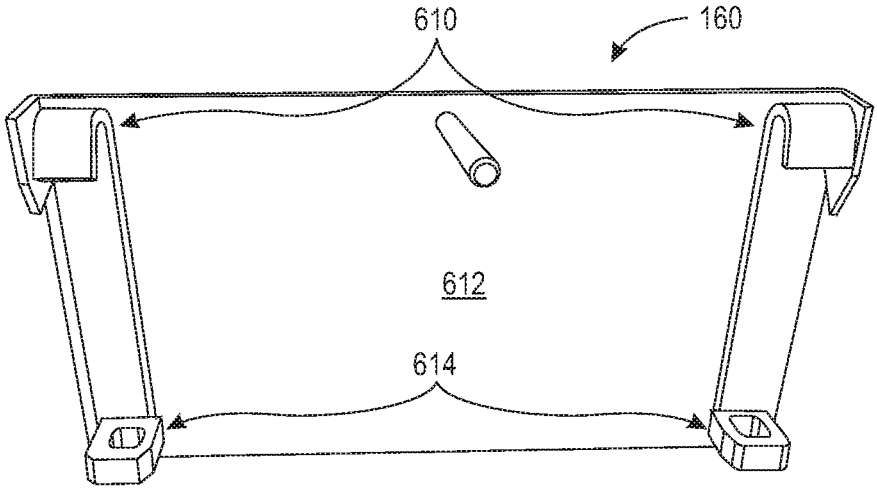
FIGS. 6A and 6B are illustrative examples of alternative couplers from the vehicle side.
Figure 6B:
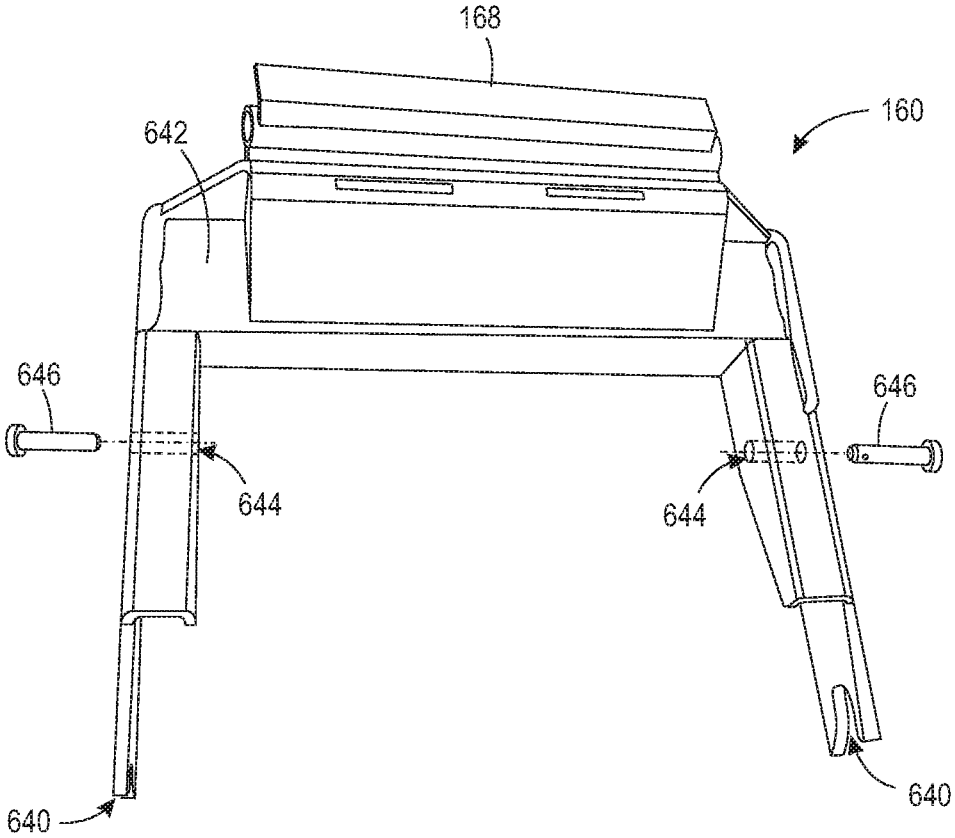
Figure 7:
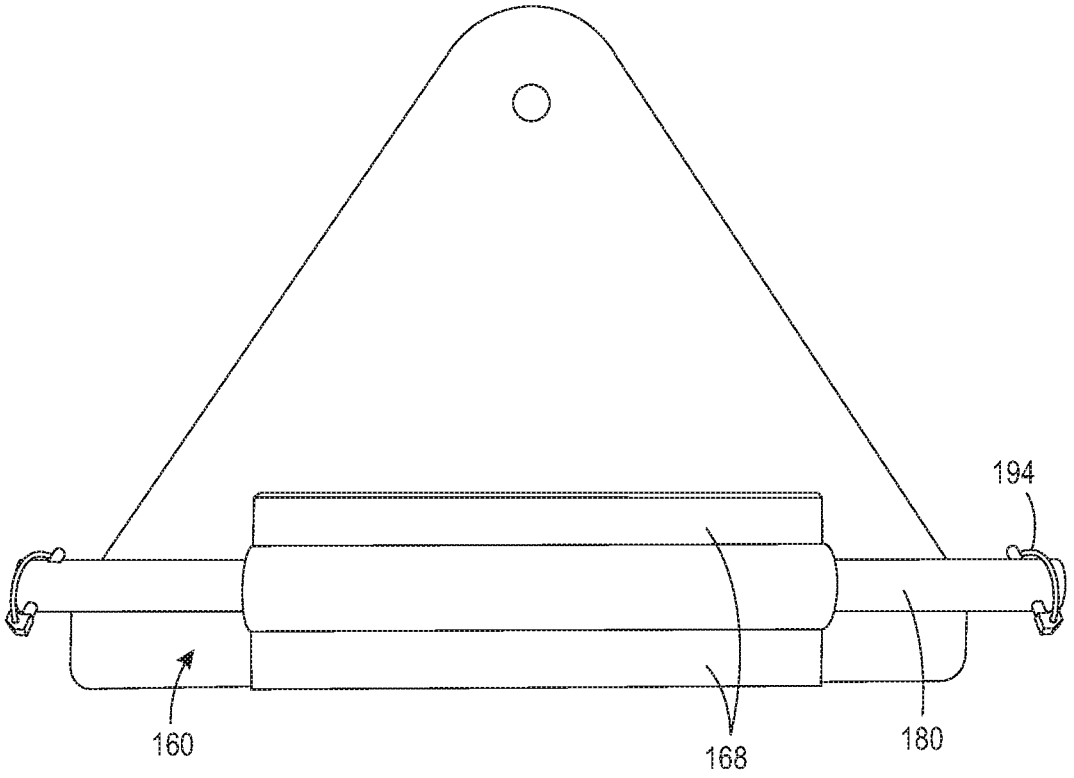
FIG. 7 is an illustrative example of an alternative coupler from the plow side.

Referring to FIGS. 6A and 6B, these figures, respectively, illustrate examples of alternative coupling systems 100, or more particularly vehicle coupler 160 for both Avant Tecno and Steiner tractors. In the case of coupler 160 in FIG. 6A, the vehicle side is similar to the known adapter plate (e.g., Part No. A2471 from AVANT TECNO USA Inc.) and includes a pair of attachment hooks 610 at the top of plate 612, and a foot 614 beneath the hooks, the foot having a hole for receiving a locking pin from the Avant machine to lock the adaptor in place. The vehicle coupler 160 for the Steiner vehicle has a vehicle interface similar in design to a Steiner Quick-Hitch™ System, and is illustrated in FIG. 6B, formed as a generally horizontally-oriented component that includes, on each side thereof a U-shaped receiver 640 on each end of adaptor 642, and holes 644 through which a locking pin(s) 646 may be placed to lock the adaptor to the tractor (not shown). FIG. 7 is an example of an alternative coupler 160 that is designed for a Toro tractor, and is shown from the plow or attachment side.

As will be further appreciated, while the amount of pivot about the hinge pin 180 is limited by the potential contact of the coupler and the plow, the addition of the angular limit devices 168 may be customized for particular couplers to match the capability of the vehicle. For example, a vehicle having the coupler attached directly to its frame or to a limited-lift structure would only have a small amount of permitted pivot range (arrow 190), whereas a vehicle (e.g., 210) having the ability to significantly raise/lower a plow, snow blower, bucket, etc., may have a greater pivot range to permit more flexibility in the use of the plow, for example, over uneven surfaces. Thus, the relative amount of pivot (e.g., rotation about axis 120) for a particular coupling system is dependent upon or a function of the vehicle's configuration or capability.

While in general practice the angular limit 168 would be placed on the coupler interface so that it may be customized to the vehicle as described above, it is contemplated that in an alternative embodiment the rear surface of the material pusher has the angular limit installed to control the relative amount of pivot (rotation) of the material pusher with respect to the vehicle. Also contemplated is the use of an adjustable angular limit device or configuration, where a surface of the limit device can be adjusted, or replaced with a device of different size in order to modify the pivot range.

As noted, the coupling to a vehicle is completed by insertion of a hinge pin 180 through the middle of the hinge bosses attached to the plow and the coupler, with the hinge pin spanning at least a combined length of the bosses. Preferably the hinge pin outer diameter is just slightly smaller than the diameter of the hinge bosses (e.g., from 0.5"-1.5" in diameter) and the pin extends slightly beyond the end of the outermost bosses, and also includes through holes in it that enable the use of a washer(s) and a locking mechanism such as a spring-type linch pin 194 to be placed through it in order to retain the hinge pin in place once the coupling is completed.

Figure 8A:
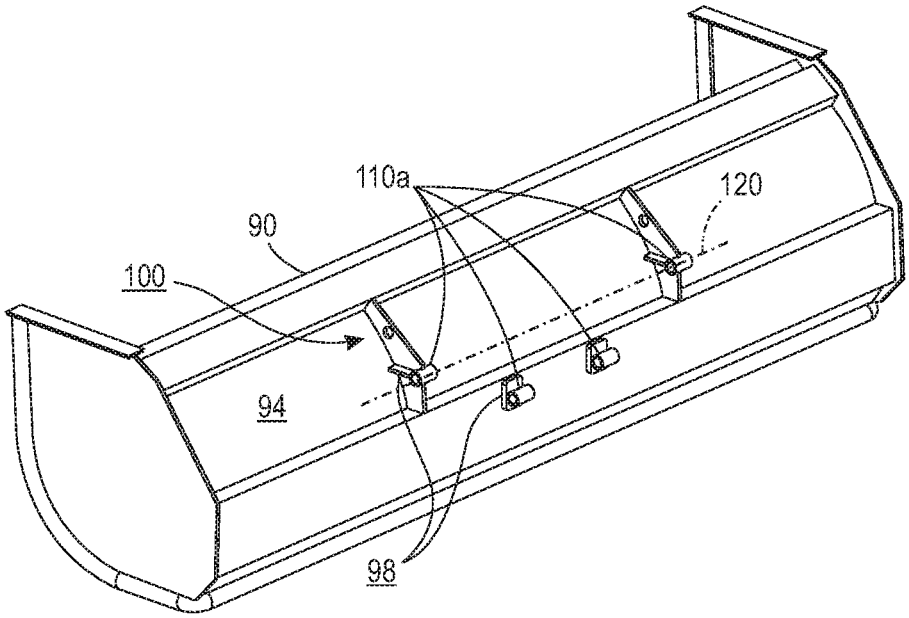
FIGS. 8A and 8B are perspective views of an alternative coupling system embodiment.
Figure 8B:
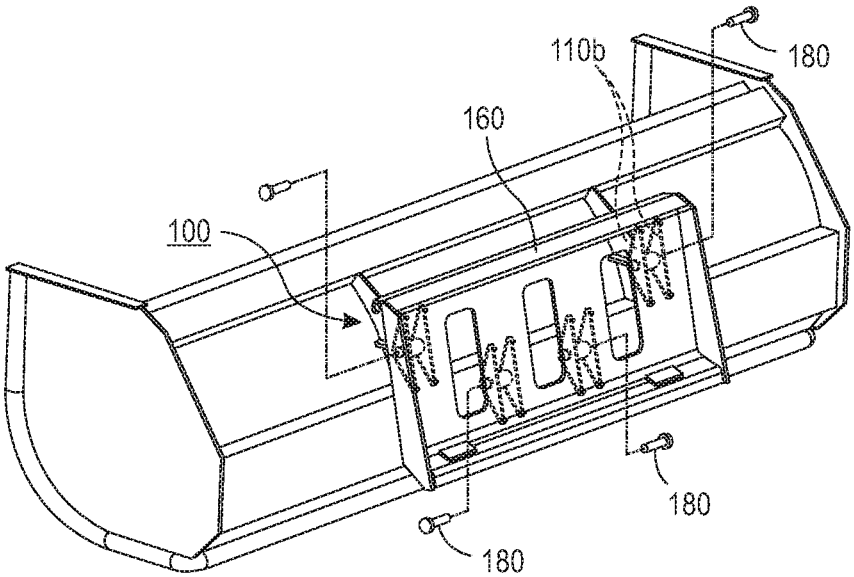

Turning now to FIGS. 8A-8B, depicted therein is an alternative embodiment of the coupling system 100 that employs multiple pins 180 and associated bosses 110 placed at several locations on the rear of the pusher 90 or similar equipment attachment. In the illustrated embodiment, several options are available for attachment and use of the equipment coupling system. For the first option, the spaced-apart first bosses 110*a* on the rear surface 94 of the snow pusher 90 are spread out to provide more stability to the coupling system. The attachment has, for at least several of the first bosses 110*a* a pair of second bosses 110*b* on the face of the coupler that "sandwich" or surround at least a pair of the first bosses 110*a*. In this first option, two of either the upper or lower pair of first bosses 110*a* may be pinned to the coupler 160 to provide the hinged coupling in a manner equivalent to the discussion above—but with shorter pins 180, permitting ease of attachment and detachment.

In the second option, each of the spaced-apart first bosses 110*a* on the attachable piece of equipment, such as pusher 90, is located and aligned along a common axis (e.g., axis 120), the axis being parallel with a longitudinal axis of the piece of equipment. The vehicle coupler 160, includes the equipment interface on the equipment-facing or front side thereof in FIG. 8B, and a vehicle interface on the vehicle-facing or rear side thereof, and the equipment interface includes at least one pair of second bosses 110*b* for several or each of the first bosses 110*a* on the rear of equipment. Moreover, each of the first bosses and associated pair of second bosses has a common-sized pin extending through them to connect the first and second bosses, and to thereby cause the piece of equipment and the vehicle coupler to be connected to one another. In the illustration of FIG. 8B, if all four pins 180 are employed, the coupler provides for a non-pivoting attachment of the equipment to the vehicle—which may be preferable in certain vehicle and equipment use configurations (e.g., where the vehicle itself includes an adjustable-angle attachment that allows an operator to change or control the angle of the equipment when it is attached for use). As will be appreciated from a review of FIG. 8A, each of the first bosses 110*a* further includes a reinforcement 98 so as to spread the load applied to the first boss during use over a larger portion or structure of the pusher rear surface 94.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. A material pusher coupling system, consisting of:

a material pusher having at least a pair of spaced-apart hinge bosses attached to a rear of the pusher and located along a common axis, said axis being parallel with a longitudinal axis of the material pusher;

a vehicle coupler including a pusher interface on one side thereof and a vehicle interface on another side thereof, where the pusher interface includes at least one hinge boss, operatively associated with the spaced apart hinge bosses of said material pusher such that a common hinge pin extends through the interior of the spaced-apart hinge bosses and the at least one hinge boss on the vehicle coupler, to cause the material pusher and the vehicle coupler to be connected only in a pivoting, hinged connection to one another via the common hinge pin extending through the hinge bosses of said material pusher and said vehicle coupler aligned along the common axis; and wherein the vehicle interface is suitable for attachment to components of the vehicle to facilitate movement of the material pusher for use.

2. The coupling system according to claim 1, wherein the pusher interface of the vehicle coupler includes an angular limit to control the relative range of pivot (rotation) of the material pusher with respect to the vehicle.

3. The coupling system according to claim 2, wherein relative range of pivot (rotation) is dependent upon the vehicle's configuration.

4. The coupling system according to claim 1, wherein the rear surface of the material pusher includes an angular limit to control the relative range of pivot (rotation) of the material pusher with respect to the vehicle.

5. The coupling system according to claim 1, wherein said hinge pin spans at least a combined length of the pair of spaced-apart hinge bosses and the at least one hinge boss.

6. The coupling system according to claim 1 where the material pusher consists essentially of a containment plow.

7. The coupling system according to claim 1 where the pair of spaced-apart hinge bosses and at least one hinge boss are each formed of elongated hollow members through which said hinge pin can be inserted.

8. An equipment coupling system, consisting of:

an attachable piece of equipment having at least one equipment hinge boss attached to a rear thereof, the hinge boss being located along a common axis, said common axis being parallel with a longitudinal axis of the piece of equipment;

a vehicle coupler including an equipment interface on one side thereof and a vehicle interface on another side thereof, where the equipment interface includes at least one coupler hinge boss suitable for alignment along said common axis at a position adjacent the at least one equipment hinge boss, where a common hinge pin extends through the interior of the equipment and coupler hinge-bosses to cause the piece of equipment and the vehicle coupler to be connected to one another only in a single pivoting, hinged connection along the common axis via the at least one common hinge pin extending through the equipment hinge boss and the at least one coupler hinge boss; and wherein the vehicle interface is suitable for attachment to components of the vehicle.

9. The coupling system according to claim 8, wherein the equipment interface of the vehicle coupler includes an angular limit to control the relative range of pivot of the piece of equipment with respect to the vehicle coupler.

10. The coupling system according to claim 9, wherein relative range of pivot is a function of vehicle configuration.

11. The coupling system according to claim 8, wherein said hinge pin spans at least a combined length of the pair of spaced-apart hinge bosses and the at least one coupler hinge boss.

12. The coupling system according to claim 8 where the attachable piece of equipment consists essentially of a containment plow.

13. An equipment coupling system, consisting of:

an attachable piece of equipment having at least one pair of spaced-apart first bosses attached to a rear thereof, each of said pair of first bosses being located and aligned along a common axis, said axis being parallel with a longitudinal axis of the piece of equipment;

a vehicle coupler including an equipment interface on one side thereof and a vehicle interface on another side thereof, where the equipment interface includes at least one pair of second bosses for each of the first bosses on the attachable piece of equipment, wherein for each of said first bosses and associated pair of second bosses a common pin extends through the interior of the first boss and pair of second bosses, all along the common axis, to cause the piece of equipment and the vehicle coupler to be connected to one another only along the common axis; and wherein the vehicle interface is suitable for attachment to components of the vehicle to which the piece of equipment is to be attached for use.

14. The equipment coupling system according to claim 13, further including at least one additional boss located and attached to the rear of said attachable piece of equipment along the common axis, and where the vehicle coupler further includes at least a pair of additional second bosses for each additional boss on the rear of said attachable piece of equipment and along the common axis, the additional boss and associated additional second bosses being aligned so as to permit the common pin to be placed therethrough along the common axis.

15. The equipment coupling system according to claim 13 where the attachable piece of equipment consists essentially of a containment plow.

* * * * *